US005592356A

United States Patent [19]

Ryl et al.

[11] Patent Number: 5,592,356

[45] Date of Patent: Jan. 7, 1997

[54] DUAL COIL ACTUATOR WITH TIMING CIRCUIT

[75] Inventors: Kendall Ryl, Arlington Heights; George A. Hollins, Palos Park; Gregory L. Pence, Lisle, all of Ill.

[73] Assignee: Synchro-Start Products, Inc., Niles, Ill.

[21] Appl. No.: 312,773

[22] Filed: Sep. 27, 1994

[51] Int. Cl.[6] ..... H01H 47/04

[52] U.S. Cl. ..... 361/154; 361/142; 361/210; 361/819

[58] Field of Search ..... 361/139, 152, 361/154, 155, 156, 160, 166, 170, 187, 195, 196, 197, 210, 819, 142

[56] References Cited

U.S. PATENT DOCUMENTS

| | | | |
|---|---|---|---|
| 3,337,778 | 8/1967 | Becker | 361/142 |
| 3,456,165 | 7/1969 | Sternberg . | |
| 3,562,595 | 2/1971 | Swanson et al. . | |
| 3,870,877 | 3/1975 | Tolbird | 361/142 |
| 4,086,645 | 4/1978 | Gorman et al. | 361/155 |
| 4,276,631 | 6/1981 | Fujita et al. | 361/195 |
| 4,331,880 | 5/1982 | Dittman et al. | 361/195 |
| 4,338,651 | 7/1982 | Henrich | 361/154 |
| 4,355,619 | 10/1982 | Wilkinson | 123/490 |
| 4,452,210 | 6/1984 | Sasayama et al. | 361/154 |
| 4,508,399 | 4/1985 | Dowling et al. | 439/67 |
| 4,609,965 | 9/1986 | Baker | 361/160 |
| 4,630,165 | 12/1986 | D'Onofrio | 361/154 |
| 4,893,213 | 1/1990 | Apostolides | 361/191 |
| 4,925,156 | 5/1990 | Stoll et al. | 361/154 |
| 5,159,522 | 10/1992 | Gray | 361/154 |
| 5,168,418 | 12/1992 | Hurley et al. | 361/155 |
| 5,289,148 | 2/1994 | Siglock et al. . | |
| 5,291,170 | 3/1994 | Wahba et al. . | |
| 5,377,068 | 12/1994 | Kaylor et al. | 361/154 |
| 5,486,972 | 1/1996 | Taylor | 361/142 |

FOREIGN PATENT DOCUMENTS

| | | |
|---|---|---|
| 0049188 | 4/1982 | European Pat. Off. . |
| 0602001A2 | 6/1994 | European Pat. Off. . |
| 2697069 | 4/1994 | France . |
| 2643597 | 4/1977 | Germany . |
| A63-300503 | 12/1988 | Japan . |

*Primary Examiner*—Fritz Fleming
*Attorney, Agent, or Firm*—Wallenstein & Wagner, Ltd.

[57] ABSTRACT

A solenoid actuator for controlling the flow of fuel used by an engine is provided. The solenoid actuator includes a solenoid housing, timing circuit housing and a solenoid connector. The solenoid housing contains a pull coil and a hold coil. First side and second side pull coil conductors are electrically connected to a first side and a second side of the pull coil, respectively. Similarly, first side and second side hold coil conductors are electrically connected to a first side and second side of the hold coil. The first and second side, pull and hold coil conductors all exit from the solenoid housing. A timing circuit housing containing a timing circuit receives the first and second side, pull and hold coil conductors. The second side pull coil conductor is connected to the timing circuit. A ground conductor extends from the timing circuit housing and is electrically connected to the timing circuit and the second side hold coil conductor. Means are provided in the timing circuit for switching the second side pull coil conductor from an electrical connection with the ground conductor to an open circuit. First and second power conductors extend from the timing circuit housing and are electrically connected to the first side hold coil conductor and the first side pull coil conductor, respectively. A solenoid connector receives the first and second power conductors and the ground conductor.

35 Claims, 9 Drawing Sheets

DUAL COIL ACTUATOR WITH TIMING CIRCUIT

DESCRIPTION

1. Technical Field

The present invention relates generally to solenoid actuation devices, and more particularly, to dual coil solenoid devices used for controlling the flow of fuel to an engine.

2. Background of the Invention

Dual coil solenoid devices, given their high level of reliability and remote operation, are typically used in fuel-injected engines to actuate fuel injection pumps. Such devices use a high current pull coil and a low current hold coil which are customarily energized by way of a keyswitch, which keyswitch also operates the starter for the engine. A problem exists when the engine operator energizes the pull coil for prolonged periods of time by failing to disengage the keyswitch during extended engine cranking. This can cause burn-out of the pull coil and related circuitry. One approach to this problem has been to provide a timer to control de-energization of the pull coil. For example, U.S. Pat. No. 4,355,619, issued to Wilkinson, discloses a two coil solenoid driver for energizing a fuel injector. The solenoid driver rapidly opens a solenoid having a pull-in and a hold coil. The driver circuit selectively energizes each coil in response to timed metering pulses.

While Wilkinson and others provide timing circuits to control the duration of high current through the pull coil, they fail to practically provide solenoid devices which can easily replace the thousands of dual coil solenoid devices used in engines today.

For example, solenoids, in most existing engines, are joined to the engine's circuitry by a wire harness plug provided by the original equipment manufacturer ("OEM"). The OEM wire harness plug provides a fixed electrical configuration, having two or three electrical contacts, for supply to the add-on or replacement solenoid. In one particular configuration, the OEM wire harness plug provides: a first electrical contact and related circuitry capable of sustaining a low current for a long period of time without damage ("low current supply"), in line with the run position of the keyswitch; a second electrical contact and related circuitry capable of sustaining a high current for a short duration of time without damage ("high current supply"), activated by the start position of the keyswitch; and, a third electrical contact electrically connected to ground.

The solenoids in existing engines typically include a solenoid connector which mechanically mates with the OEM wire harness plug and a solenoid housing in which both coils are housed. Each of the two coils has a first side and a second side. A first wire extends from the solenoid connector to and into the solenoid housing to electrically connect the low current supply to the first side of the hold coil. A second wire extends from the connector and into the solenoid housing to electrically connect the high current supply to the first side of the pull coil. A third wire extends from the solenoid connector into the solenoid housing to electrically connect the second sides of both coils to ground. The single third wire can be used because the second side of the hold coil and the second side of the pull coil are electrically joined together within the housing and thus the third wire serves as a common-to-ground connection. For definitional purposes, the first side of a coil will be that side which is coupled to the power supply and the second side of a coil will be that side which is coupled to ground.

Others have attempted to provide solenoids with timing circuits to replace the above discussed standard three wire solenoid. However, there are problems associated with these replacement solenoids and their accompanying circuitry.

For example, it has been proposed to place a timing circuit between the current supplies and the first side of the coils to switch the pull coil off after a predetermined period. However, this switching configuration requires either a relay, which is capable of handling high current, or a group of high power transistors. Relays are not as reliable as solid state switches because of contact contamination and fatigue failures. On the other hand, the number and type of power transistors which can handle the power needed in this configuration are costly.

Alternatively, circuits have been proposed where the pull coil is switched on its second or ground side. This type of circuit requires fewer and less expensive transistors. With this circuit, the first side, or power input side, of the coils is commoned inside the solenoid housing with only one common power wire entering the solenoid housing for power connection. The second side of each coil is electrically connected to a separate conductor (wire). The conductor from the second side of the pull coil extends from the solenoid housing for connection through the timing circuit to ground, while the conductor from the second side of the hold coil extends from the solenoid housing directly to a ground. This configuration is incompatible with the fixed OEM wiring harness configuration discussed above. Thus, these circuits are not desirable for the retro-fit market, as the OEM wiring harness and/or circuit conventions must be changed on the existing vehicle in the field to accept the circuit. The same is true when such a circuit is proposed for sale as an OEM component because the OEM is not desirous of changing its existing wiring harness design.

Thus, there is a need for a solenoid actuator with a timing circuit, which timing circuit is a solid state switch for switching on the second or ground side of the pull coil and which actuator is compatible with existing OEM wiring conventions and wiring harness designs.

Another OEM wiring harness configuration provides wiring a harness plug for use with internally-switched solenoids. Such a wiring harness provides a plug having: a first electrical contact and related circuitry capable of sustaining a high current for a short duration of time without damage ("high current supply"), in-line with the run and start positions of the keyswitch; and, a second electrical contact electrically connected to ground.

Thus, there is a need for providing a solenoid actuator which is compatible with an OEM wiring harnesses used for internally switched solenoids.

Another problem exists with respect to providing a timing circuit for a solenoid for controlling a fuel injection pump or other solenoid actuated devices. Because the heat generated inside the solenoid housing can be destructive to timing circuit components, timing circuit components are conventionally housed remotely from the solenoid housing in a timing circuit housing. To-date such housings have been configured in a conventional geometric manner without due regard to the spacial environment of the vehicle engine compartment in which they are to be used. In addition, the shape and bulk of the conventional timing circuit housings have required them to be separately mounted to the vehicle, for example, on the firewall or the inner fender. This necessitates added labor and attaching materials, such as screws. Also, in a retrofit situation space may not be readily available and an OEM part or a space for mounting must be added during design. Such space reduces the amount of available space for other components.

Thus, there is a need for a timed dual coil solenoid device for controlling a fuel injection pump or other solenoid actuated device capable of replacing existing solenoids without providing for separate space and attachment of the timing circuit housing.

The present invention is designed to meet these needs and to solve these and other problems.

SUMMARY OF THE INVENTION

According to a first aspect of the invention, a solenoid actuator having a solenoid housing, timer housing and connector is provided. The solenoid housing contains a pull coil and a hold coil. The pull coil has first side and second side pull coil conductors electrically connected to its first and second side, respectively while the hold coil has first side and second side hold coil conductors electrically connected to its first and second side, respectively. The first and second side pull coil conductors and the first and second side hold coil conductors all exit from the solenoid housing and form a first wire bundle.

The timing circuit housing contains a timing circuit for deenergizing the pull coil after a predetermined period of time. This is accomplished by switching the second side pull coil conductor, from ground to an open circuit configuration. The first side pull coil conductor, first side hold coil conductor and second side hold and pull coil conductors all provide electrical and mechanical connection to the timing circuit housing and the solenoid housing. A second wire bundle electrically and mechanically connects the timing circuit housing to a solenoid connector.

The second wire bundle includes a first conductor which is electrically connected to the first side pull coil conductor within the timing circuit housing. It also includes a second conductor which electrically connects to the first side hold coil conductor within the timing circuit housing. The second wire bundle includes a third conductor which is connected to the second side hold coil conductor within the timing circuit housing and the ground of the timing circuit. The solenoid connector presents the second wire bundle to an OEM connector plug for electrical connection.

According to another aspect of the invention, the timing circuit housing has an elongated external profile which generally conforms to the profiles of the first and second wire bundles, to save space and to avoid separate mounting to the vehicle. Preferably the timing circuit housing is an elongate circular cylinder.

Other features and advantages of the invention will be apparent from the following specification taken in conjunction with the following drawings.

BRIEF DESCRIPTION OF THE DRAWINGS

In order that the present invention may be understood, it will now be described by way of example, with reference to the accompanying drawings in which.

DETAILED DESCRIPTION OF THE PREFERRED EMBODIMENT

Figures 1, 18, 19, 20:
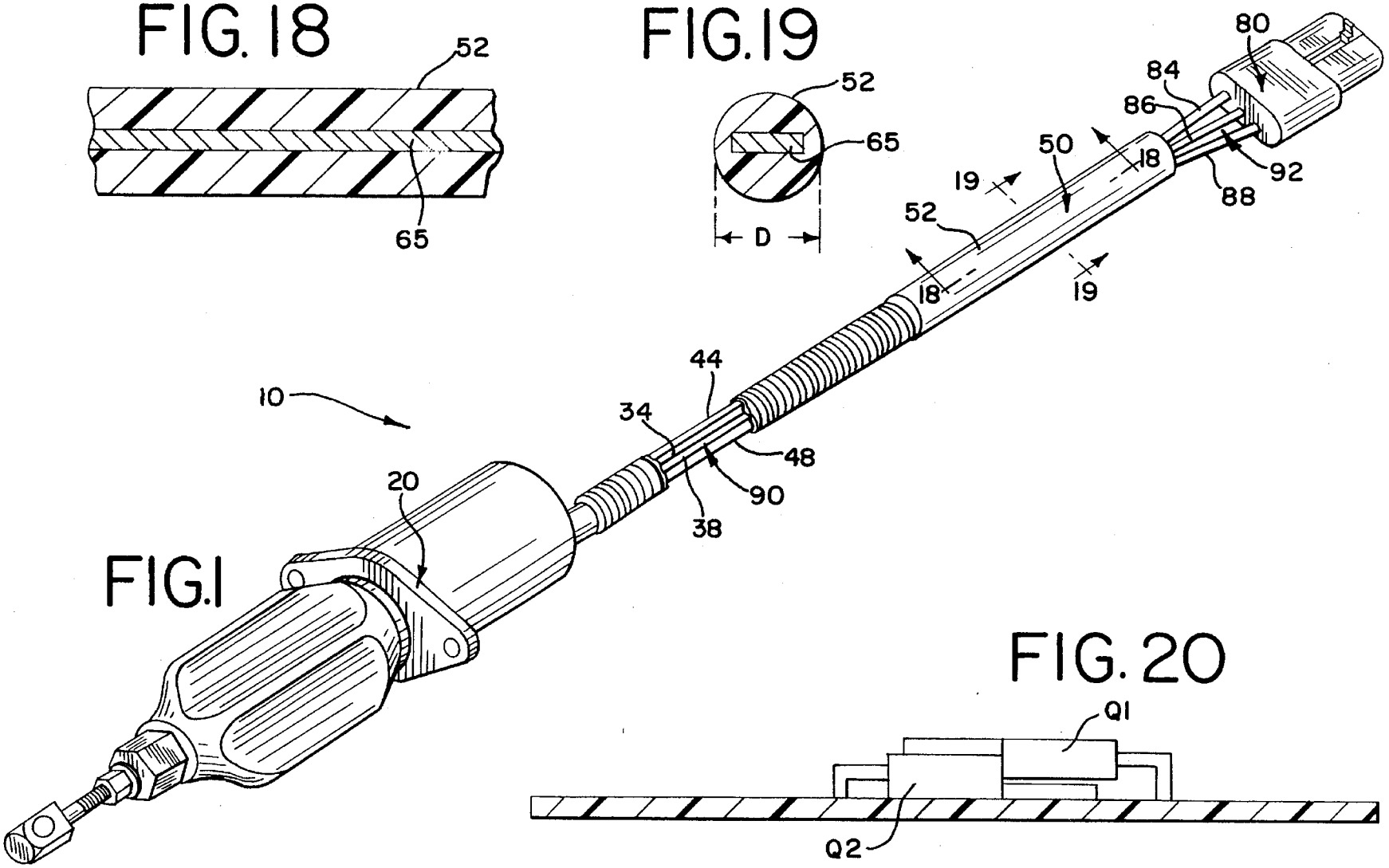
FIG. 1 is a perspective view of the solenoid actuator of the present invention.
FIG. 18 is a schematic representation of a cross-sectional view of a preferred embodiment of the timing circuit housing of FIG. 1 along line 18—18.
FIG. 19 is a schematic representation of a cross-sectional view-of the timing circuit housing of FIG. 1 along line 19—19; and, FIG. 20 is a side view of a portion of the circuit board of the present invention showing two stacked transistors.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

A total of four preferred embodiments of the invention are described herein: a 7-wire parallel version; a 6-wire parallel version; a 5-wire parallel version; and, a 5-wire series version. The 7-wire parallel version can be used with many OEM wire harness plugs having three electrical contacts while the other three embodiments can be used with many OEM wire harness plugs having two electrical contacts.

A solenoid actuator, 10, in accordance with the present invention, is disclosed in FIG. 1. The solenoid actuator 10 includes a solenoid housing 20, a timing circuit housing 50, and a solenoid connector 80.

Figure 2:
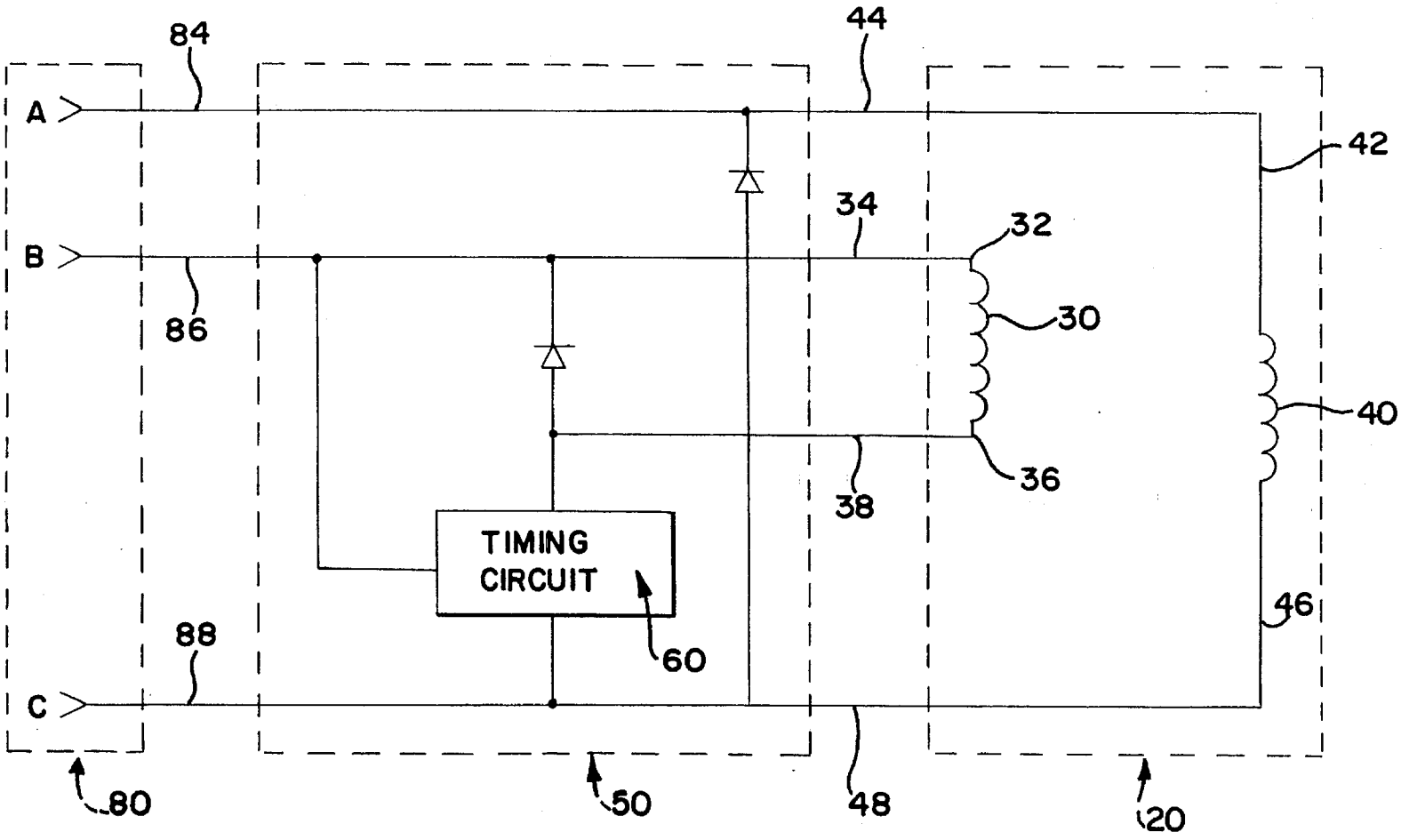
FIG. 2 is a schematic diagram of a first embodiment of the solenoid actuator of the present invention.
Figure 5:
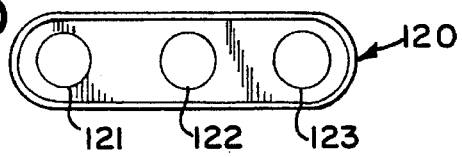
FIG. 5 is a schematic representation of the OEM wire harness plug of FIG. 4.

Referring to FIG. 2, the solenoid connector 80 has three connection pins, Pins A, B, and C, and is designed to mechanically mate with an OEM wire harness plug as shown in FIG. 5 and described in further detail below.

The solenoid housing 20 contains a pull coil 30 and a hold coil 40. The pull coil 30 and the hold coil 40 both have a first side 32, 42 and a second side 36, 46, respectively. The first side 42 of the hold coil 40 is electrically connected to Pin A of the solenoid connector 80 by a first conductor (or first power conductor) 84 via a first side hold coil conductor 44, while the first side 32 of the pull coil 30 is electrically connected to Pin B by a second conductor (or second power conductor) 86 via a first side pull coil conductor 34. The second side 46 of the hold coil 40 is electrically connected to Pin C of the solenoid connector 80 by a third conductor (or ground conductor) 88 via a second side hold coil conductor 48.

Figure 3:
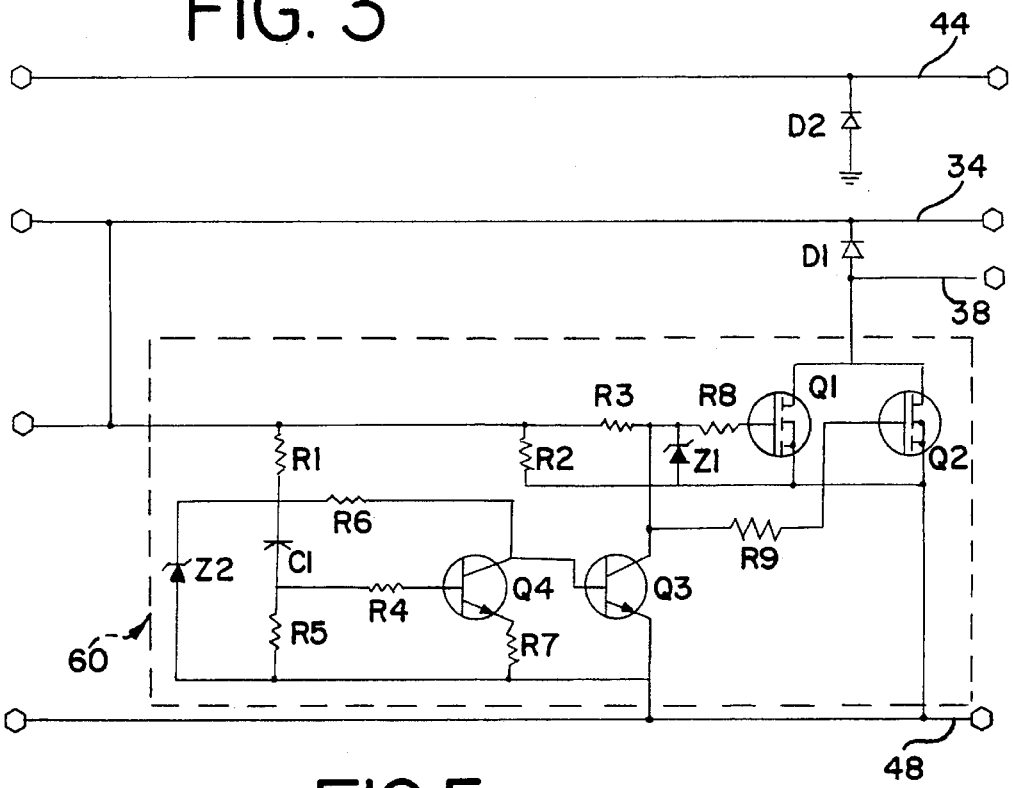
FIG. 3 is an electrical schematic diagram of a first embodiment of the solenoid actuator of the present invention.

The timing circuit housing 50 has an exterior shell 52 (shown in FIGS., 8 and 9) which contains timing circuitry 60 (shown in FIG. 3). The second side 36 of the pull coil 30 is electrically connected to the second side 46 of the hold coil 40 by the timing circuitry 60.

The timing circuitry 60 operates as a switch which is used to deenergize the pull coil 30 after a predetermined period of time. This deenergization is accomplished by disconnecting a second side pull coil conductor 38 from the third conductor 88. The timing circuitry 60, shown in FIG. 3, is used in all four embodiments of the invention as will be apparent by the description accompanying FIGS. 13, 14 and 15. The actual "switch" in the timing circuitry 60 is transistors Q1 and Q2. Initially, when power is applied to the timing circuitry 60, the transistors Q1 and Q2 are set to conduct from the second side pull coil conductor 38 to the ground conductor 88. After a predetermined time period, which is established by choosing the appropriate values for resistors R4, R5, R6 and R7 and capacitor C1, the transistors Q1 and Q2 are shut-off by the combination of transistors Q3 and Q4 and their related circuitry. Hence, no current flows from the second side pull coil conductor to the ground conductor 88.

As shown in FIG. 1, the timing circuit housing 50 is mechanically connected to the solenoid housing 20 by a first wire bundle 90. The first wire bundle 90 includes the first and second side pull coil conductors 34,38 and the first and second side hold coil conductors 44,48. The solenoid connector 80 is mechanically connected to the timing circuit housing 50 by a second wire bundle 92. The second wire bundle 92 includes the first conductor 84, the second conductor 86, and the third conductor 88.

As shown in FIG. 2, the solenoid actuator 10 has three wires connecting the solenoid connector 80 to the timing circuit housing 50 and four wires connecting the timing circuit housing 50 to the coils 30,40 in the solenoid housing 20. Furthermore, the pull coil 30 and the hold coil 40 are connected in a parallel configuration. Hence, this, the first embodiment of the invention, is referred to as the 7-wire parallel version.

The solenoid actuator 10 is switched on the second, or ground, side of the pull coil and is compatible with many existing OEM wiring harnesses having plugs with three electrical contacts, as will be shown by way of example below.

Figure 4:
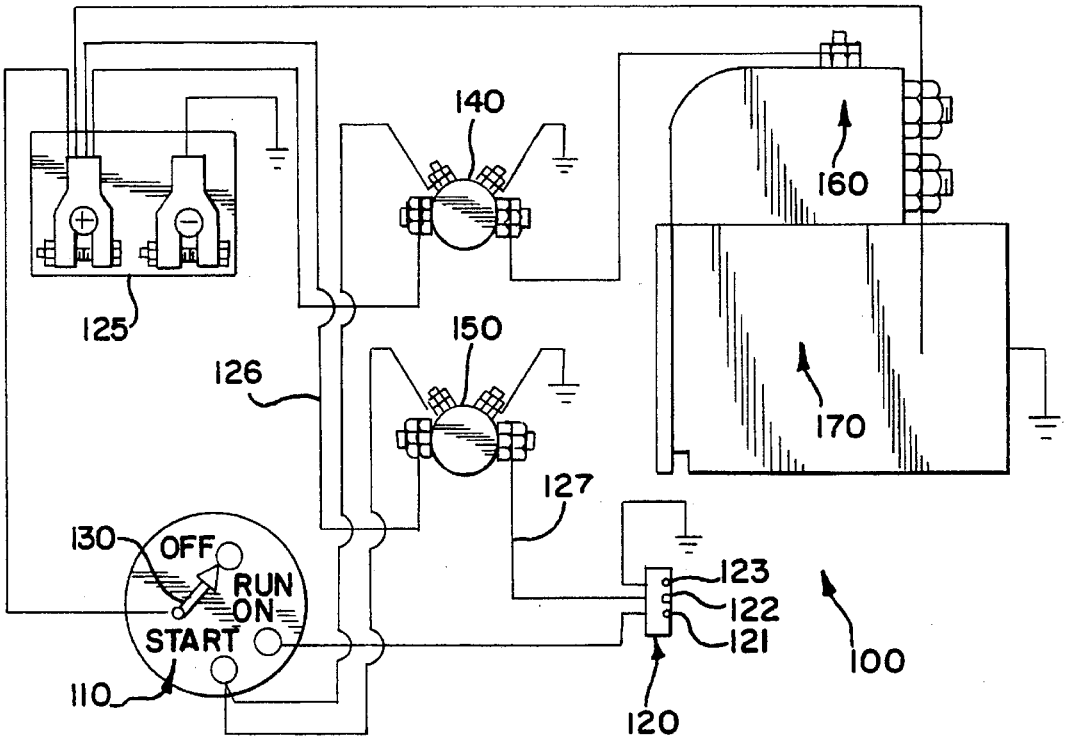
FIG. 4 is a schematic representation of a wiring harness configuration with which the present invention can be used.

A first OEM wiring harness 100 is shown in FIG. 4. The OEM wiring harness 100 provides an OEM wiring harness plug 120. As disclosed in FIG. 5, the plug 120 has a first electrical contact 121, a second electrical contact 122, and a third electrical contact 123. The plug 120 mechanically mates with the solenoid connector 80. Referring back to FIG. 4, a keyswitch 110, having start, run and off positions, is used to activate the power supplied to the contacts of the OEM wire harness plug 120. The first electrical contact 121 and its related circuitry is capable of withstanding a low current for a long period of time when the keyswitch 110 is in the run or start position. When the keyswitch 110 is in the start position, a fuel solenoid relay 150 is activated. This activation connects pin 122 to a battery 125 through conductors 126,127. The second electrical contact 122 and its related circuitry is capable of withstanding a high current for a relatively short period of time when the keyswitch 110 is in the start position. A negative ground connection is provided at the third electrical contact 123. The first, second and third electrical contacts 121, 122, 123 are electrically connected to Pins A, B, and C, respectively, of the solenoid connector 80 when connector 80 is engaged with plug 120. The key switch contact mechanism is rotary as represented schematically by wiper contact 130 of keyswitch 110. Accordingly, the keyswitch 110, must pass by the run position to reach the start position from the off position. In the off position, no power is available at the first, second or third electrical contacts 121, 122, 123 of the connector plug 120.

When the engine is being started, the keyswitch 110 is turned from its initial off position and passes through the run position on its way to the start position. As it passes the run position, power is applied from battery 125 directly through the wiper contact 130 in the keyswitch 110, and low current is drawn by the hold coil 40 through the first electrical contact 121 of the OEM wire harness plug 120. Thus, the hold coil 40 is activated. This power remains available even after the keyswitch 110 is turned to the start position and after the keyswitch 110 is urged back by a switch spring (not shown) to the run position. When the keyswitch 110 is in the run position, no current flows through the second electrical contact 122 of the connector plug 120 because the circuit connecting the pull coil 30 remains open.

When the keyswitch 110 is turned to the start position, power is supplied through the wiper contact 130 of the keyswitch 110 to starter relay 140 and a fuel solenoid relay 150. The current supplied from the battery through the wiper contact 130 activates the starter relay 140 and a high current is drawn by a starter solenoid 160 to crank a starter motor 170. At the same time, the fuel solenoid relay 150 is activated and the pull coil 30 draws a high current through the second electrical contact 122 of the OEM connector plug 120. Initially, the pull coil 30 is connected to ground through the timing circuit 60.

Because the pull coil 30 draws high current, keeping the pull coil 30 on for an extended period of time can cause burn-out. This can easily happen when an operator holds the keyswitch 110 in the start position for a prolonged period of time, to activate the starter motor 170 in attempting to get the engine to start. Consequently, the timing circuit 60, after a predetermined period of time, will disconnect the second side pull coil conductor 38 from the ground conductor 88, shutting off the pull coil 30 by opening the circuit. Preferably, this disconnection occurs approximately one-half (0.5) to one and a half (1.5) seconds after the pull coil 30 has been activated. The hold coil 40 remains activated after the pull coil 30 has been disconnected. Disengaging the pull coil in this time frame also reduces power drain from battery 125.

Figure 7:
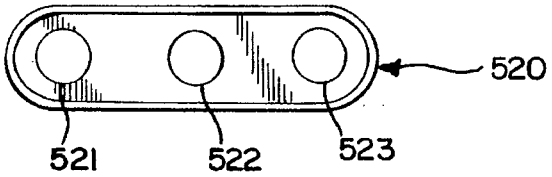
FIG. 7 is a schematic representation of the OEM wire harness plug of FIG. 6.
Figure 6:
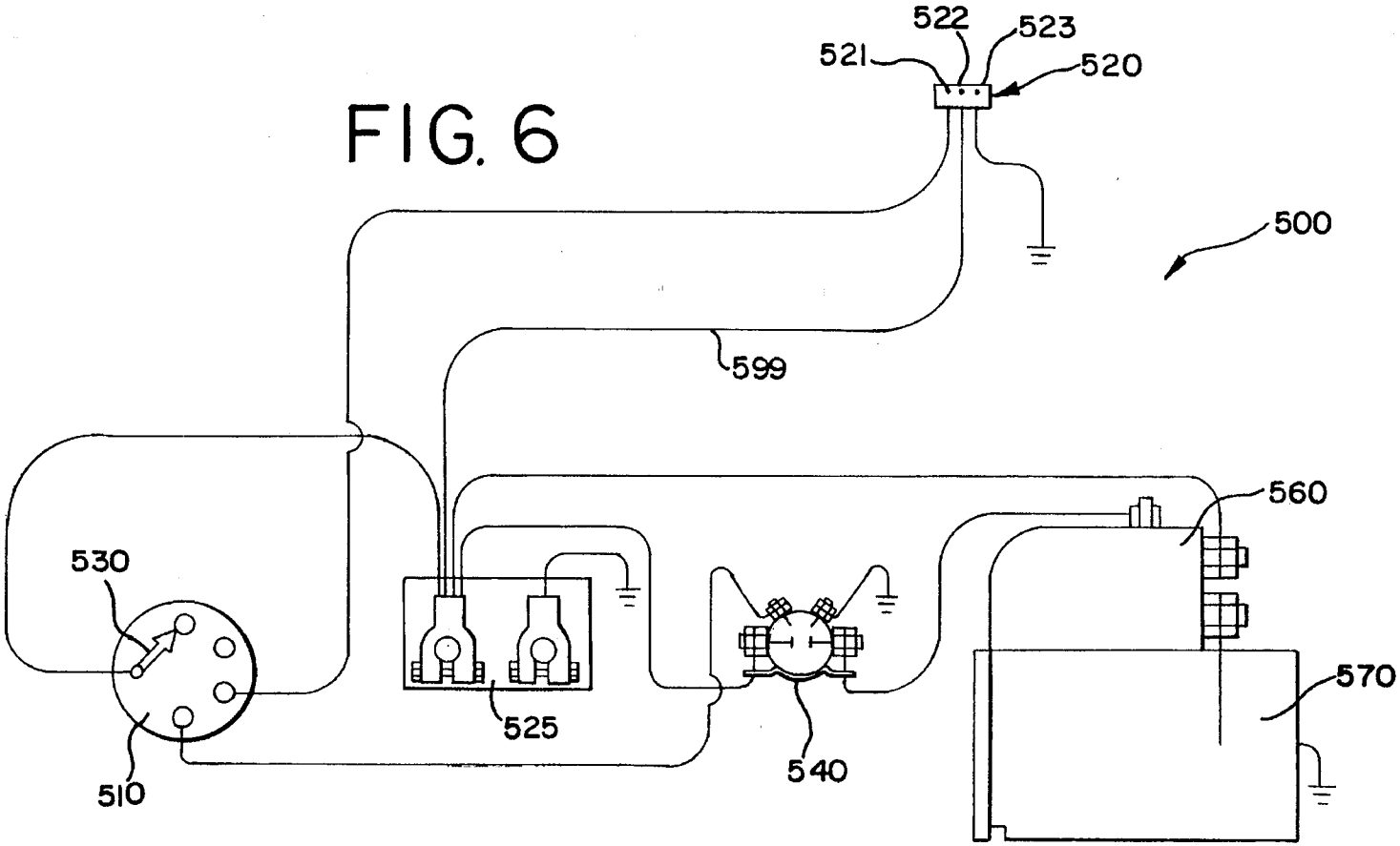
FIG. 6 is a schematic representation of a second wiring harness configuration with which the present invention can be used.

An example of a second OEM wiring harness with which the present invention can be used is shown in FIG. 6. The OEM wiring harness 500 provides an OEM wiring harness plug 520 shown in FIG. 7. The plug 520 has a first electrical contact 521, a second electrical contact 522, and a third electrical contact 523. The plug 520 mechanically mates with the solenoid connector 80. Referring back to FIG. 6, a keyswitch 510, having start, run and off positions, is used to activate the power supplied to the contacts of the OEM wire harness plug 520. The first electrical contact 521 and its related circuitry is capable of withstanding a low current for a long period of time when the keyswitch 510 is in the run or start position. The second electrical contact 522 and its related circuitry is capable of withstanding a high current for a relatively short period of time. A negative ground connection is provided at the third electrical contact 523. The first, second and third electrical contacts 521, 522, 523 are electrically connected to Pins A, B, and C, respectively, of the solenoid connector 80 when connector 80 is engaged with plug 520. The keyswitch contact mechanism is rotary as represented schematically by wiper contact 530 of keyswitch 510. Accordingly, the keyswitch 510, must pass by the run position to reach the start position from the off position. In the off position, no power is available at the first, or third electrical contacts 521,523 of the connector plug 520.

When the engine is being started, the keyswitch 510 is turned from its initial off position and passes through the run position on its way to the start position. As it passes the run position, power is applied from battery 525 directly through the wiper contact 530 in the keyswitch 510, and low current is drawn by the hold coil 40 through the first electrical contact 521 of the OEM wire harness plug 520. Thus, the hold coil 40 is activated. This power remains available even after the keyswitch 510 is turned to the start position and after the keyswitch 510 is urged back by a switch spring (not shown) to the run position.

Figure 8:
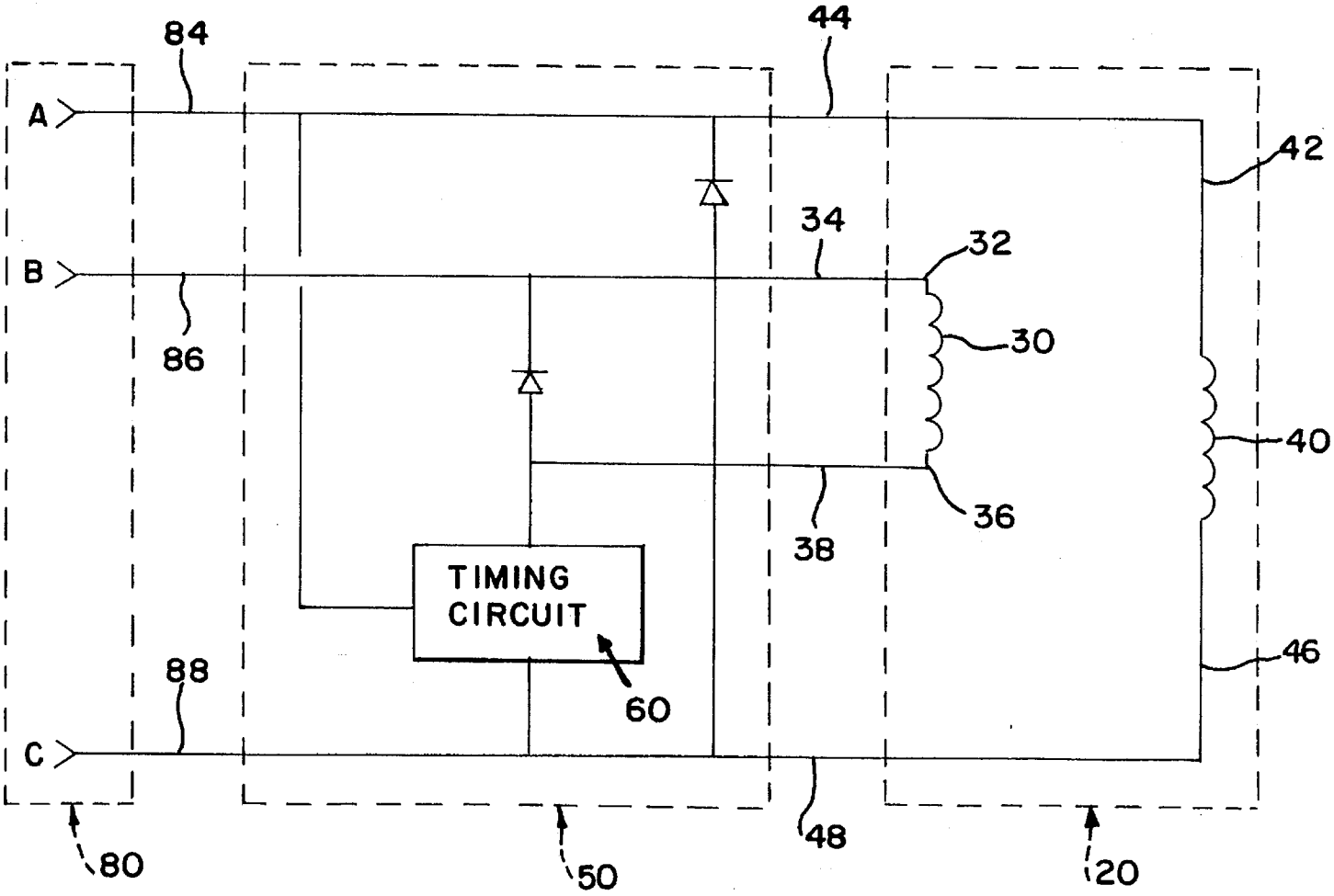
FIG. 8 is a schematic representation of a modified first embodiment of the invention to be used with the second wiring harness configuration.
Figure 9:
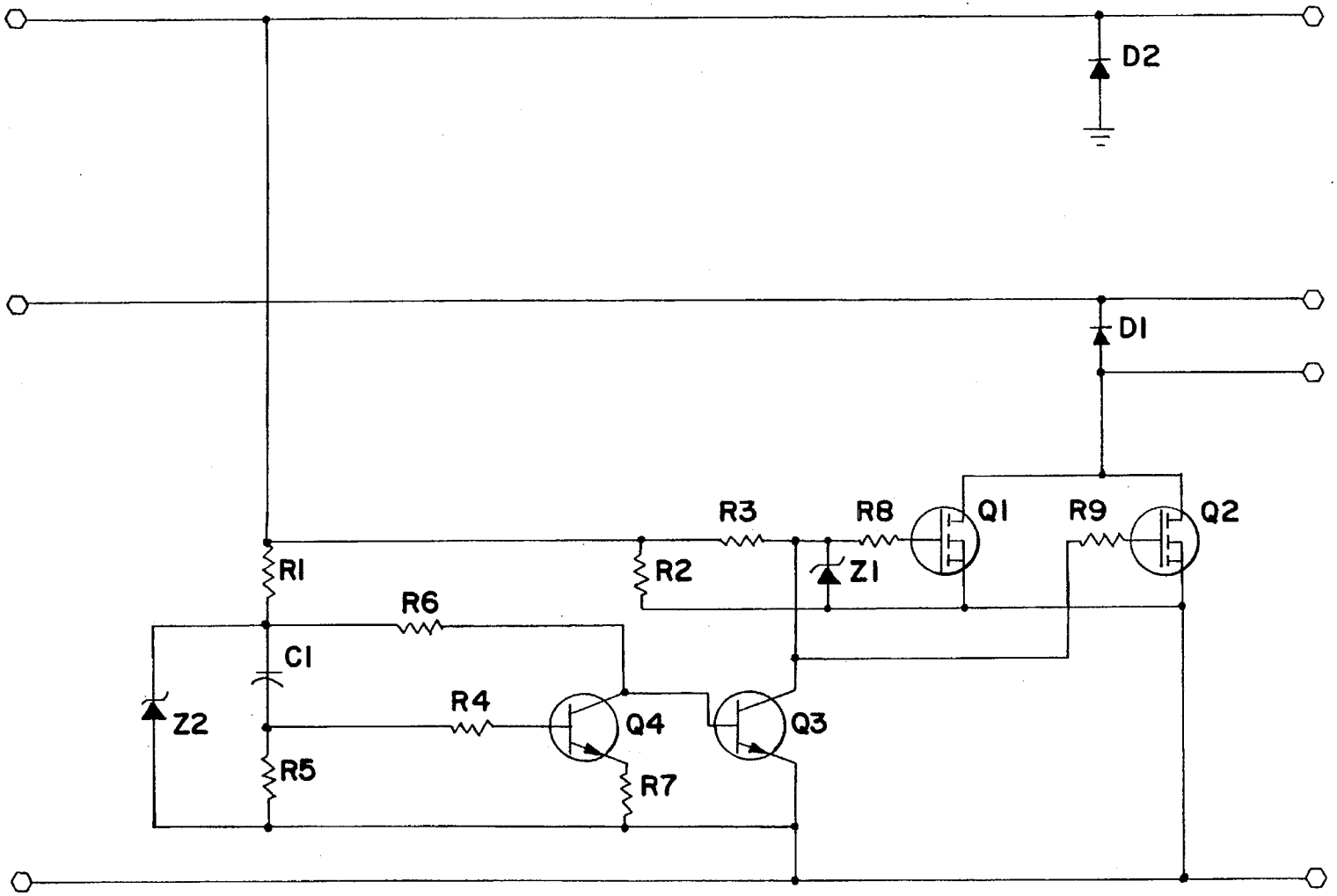
FIG. 9 is a electrical schematic representation of a modified first embodiment of the invention to be used with the second wiring harness configuration.

Since the battery 525 is directly connected to the second electrical contact 522 via conductor 599, power is always made available at the second electrical contact 522. With reference to FIGS. 8 and 9, initially, the timing circuit 60 is in an open circuit configuration and the pull coil 30 is not activated. As power is delivered to the hold coil 40 (when the keyswitch 510 passes by the run position), the timing circuit 60 is closed. Thus, the pull coil 30 is able to draw a high current through the second electrical contact 522. After a predetermined period of time, as determined by chosen values for capacitor C1 and resistors R4, R5, R6 and R7, the timing circuit 60 disengages the pull coil 30 to avoid burn-out.

Referring back to FIG. 6, when the keyswitch 510 is turned to the start position, power is supplied through the wiper contact 530 of the keyswitch 510 to starter relay 540. The current supplied from the battery through the wiper contact 530 activates the starter relay 540 and a high current is drawn by a starter solenoid 560 to crank a starter motor 570.

When using the OEM wiring harness 500, power to the timing circuitry 60 is obtained from an electrical connection to Pin A rather than Pin B as shown in FIGS. 8 and 9. In all other respects, FIGS. 8 and 9 are identical to FIGS. 3 and 4.

Figure 10:
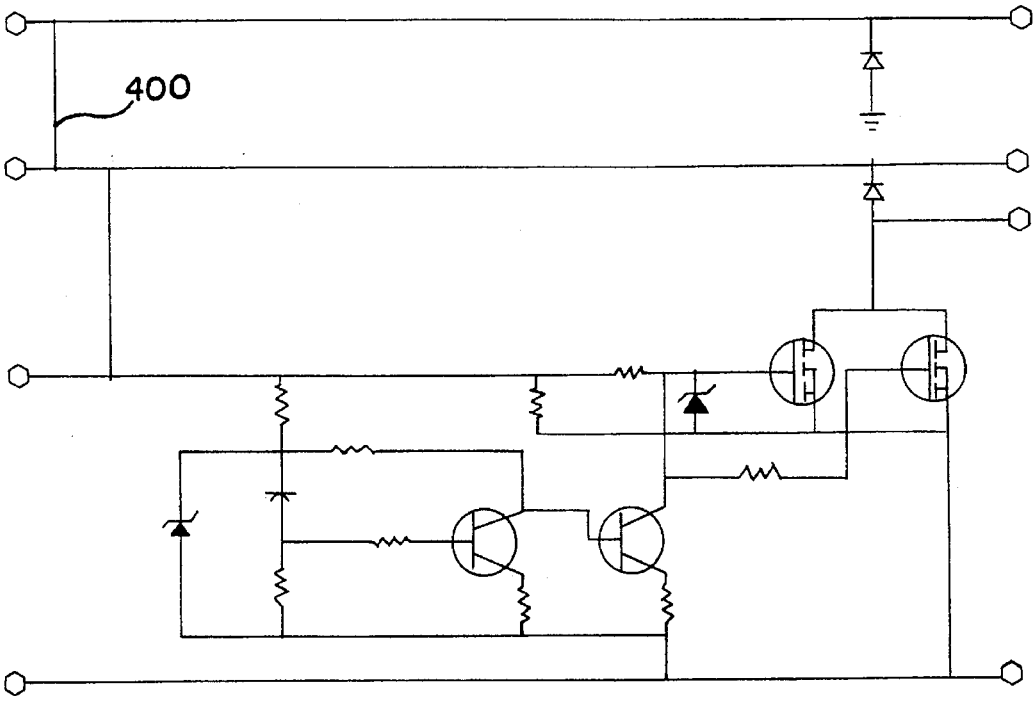
FIG. 10 is an electrical schematic diagram of a second embodiment of the solenoid actuator of the present invention.

A second embodiment of the present invention, shown in FIG. 10, can be used with an OEM wiring harness having a plug with two electrical contacts. Such a wiring harness is typically used for internally-switched dual coil solenoid actuators. This arrangement allows the replacement of the actuator contacts with the more reliable timer circuitry. The electrical schematic diagram for the second embodiment of the invention is identical to that of the first embodiment shown in FIG. 3 except for the electrical connection via conductor 400 between the first side pull coil conductor 34 and the first side hold coil conductor 44 inside the timing circuit housing 50.

Figure 11:
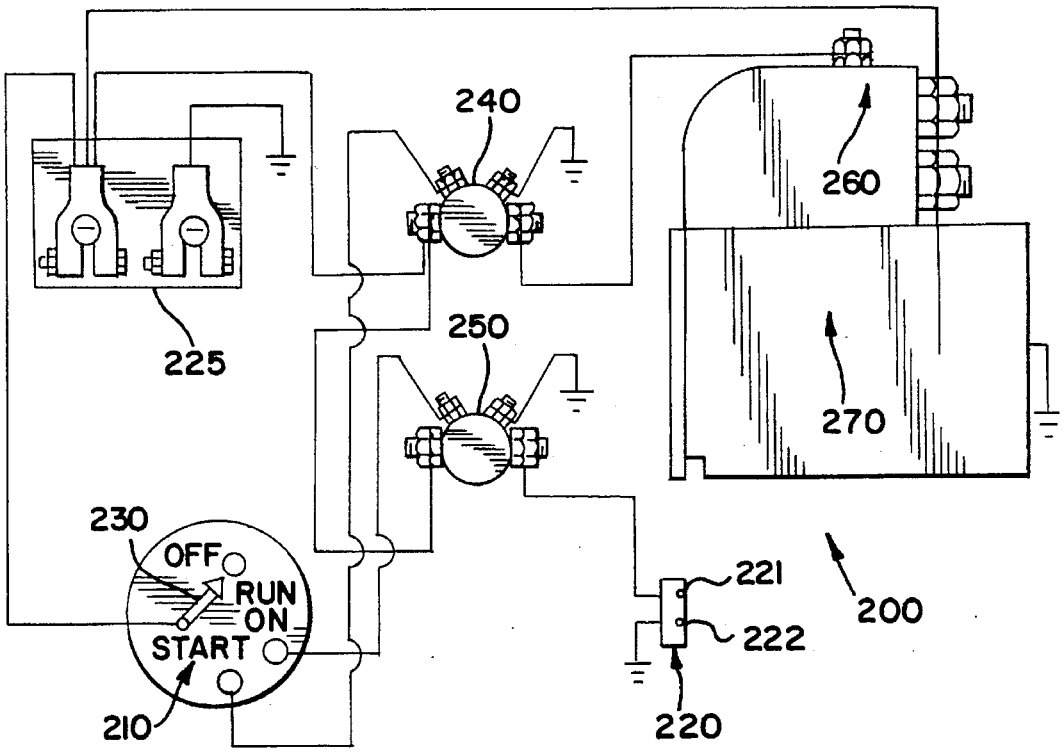
FIG. 11 is a schematic representation of a third wiring harness configuration with which the present invention can be used.
Figure 12:
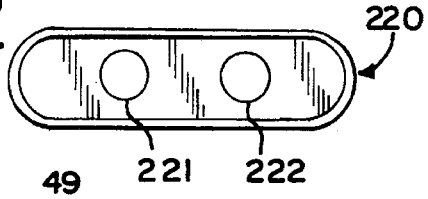
FIG. 12 is a schematic representation of the OEM wiring harness plug of the wiring harness configuration of FIG. 11.

FIG. 11 discloses an exemplary OEM wiring harness 200 for which the second embodiment of the invention can be used. The OEM wiring harness 200 provides a keyswitch 210 to activate the power applied to an OEM wire harness plug 220, having a first electrical contact 221 and a second electrical contact 222 (See FIG. 12), which mechanically mates with a solenoid connector 180 (shown and described in FIG. 13 below). The solenoid connector 180 is the same as the solenoid connector 80, discussed above, except that it only has two pins, Pins A and B, instead of three. The first and second electrical contacts, 221 and 222, are electrically connected to Pins A and B, respectively. As shown in FIG. 11, the keyswitch 210 has three positions: an off position, a run position and a start position. The keyswitch mechanism is rotary as represented schematically by wiper contact 230. Accordingly, the keyswitch 210 must pass by the run position to reach the start position. In the off position, no power is available at the OEM wire harness plug 220. The second electrical contact 222 provides a ground wire or ground connector at Pin B.

As the key passes through the run position on its way to the start position, power is applied from a battery 225 directly through the wiper contact 230 in the keyswitch 210 which activates a fuel solenoid relay 250, thus making a voltage available at the OEM connector plug 220 at the first electrical contact 221 for the first side hold coil wire 44 at Pin A. Since the first side hold coil wire 44 and the first side pull coil wire 34 are electrically connected, both the hold coil 40 and the pull coil 30 are energized. The power remains available at the first electrical contact 221 of the OEM wire harness plug 220 even after the keyswitch 210 is turned to the start position and after it "springs back" to the run position.

Figure 13:
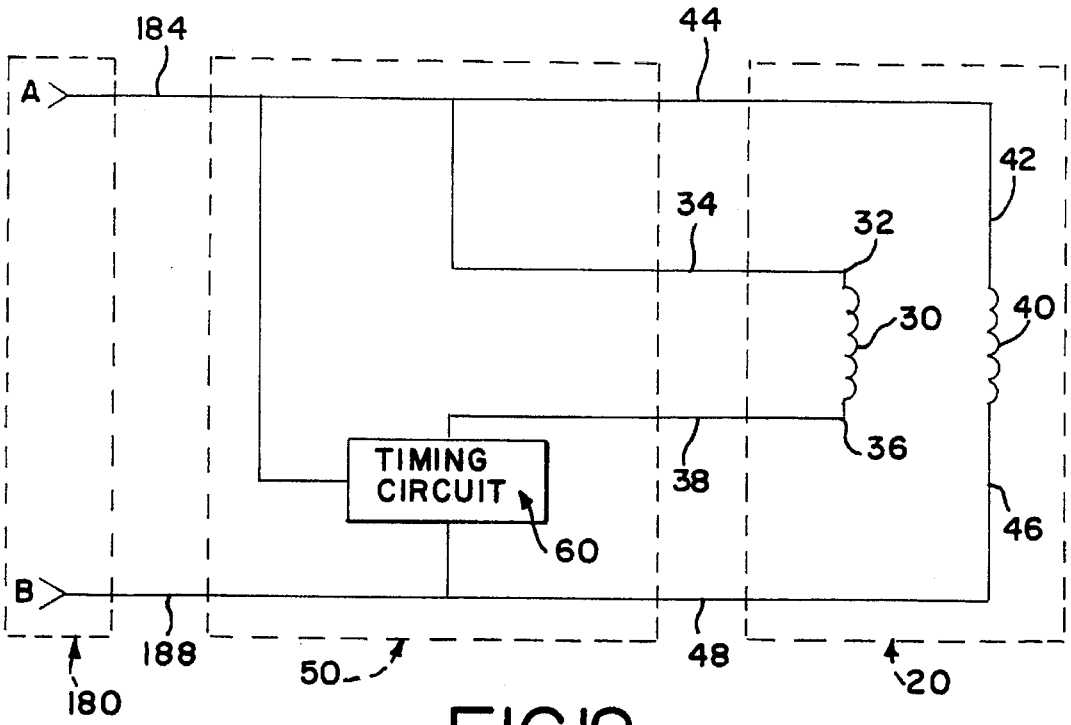
FIG. 13 is a schematic diagram of a second embodiment of the solenoid actuator of the present invention.

Referring to FIG. 13, initially the pull coil 30 is connected to ground through the timing circuit 60. However, in order to minimize burn out, the timing circuit 60, after a predetermined period of time, will disconnect the second side pull coil conductor 38 from ground by opening the circuit. Preferably, this disconnection occurs one-half (0.5) to one and a half (1.5) seconds after the pull coil 30 has been activated. The hold coil 40 remains activated after the pull coil 30 has been disconnected.

The pull coil 30 and the hold coil 40 are designed so that when both coils are energized the pull coil 30 draws a high current and the hold coil 40 draws a low current. Once the pull coil 30 has been de-energized, the hold coil 40 continues to draw a low current.

As shown in FIG. 1, when the keyswitch 210 is turned to the start position, power is supplied through the wiper contact 230 of the keyswitch 210 to a starter relay 240. The current supplied from the battery through the key 230 activates the starter relay 240 and a high current is drawn by a starter solenoid 260 to crank the starter motor 270. As mentioned above, power is still made available to the OEM wire harness plug 220 for Pin A.

As shown in FIG. 3, in the second embodiment described above, the first (or power) conductor 184 and second (or ground) conductor 188 connect the solenoid connector 180 to the timing circuit housing 50 and first and second side pull and hold coil conductors 34, 38, 44, 48 connect the timing circuit housing 50 to the coils 30,40 in the solenoid housing 20. Furthermore, the pull coil 30 and the hold coil 40 are connected in a parallel configuration. Hence, this embodiment of invention is referred to as the 6-wire parallel version.

Figure 14:
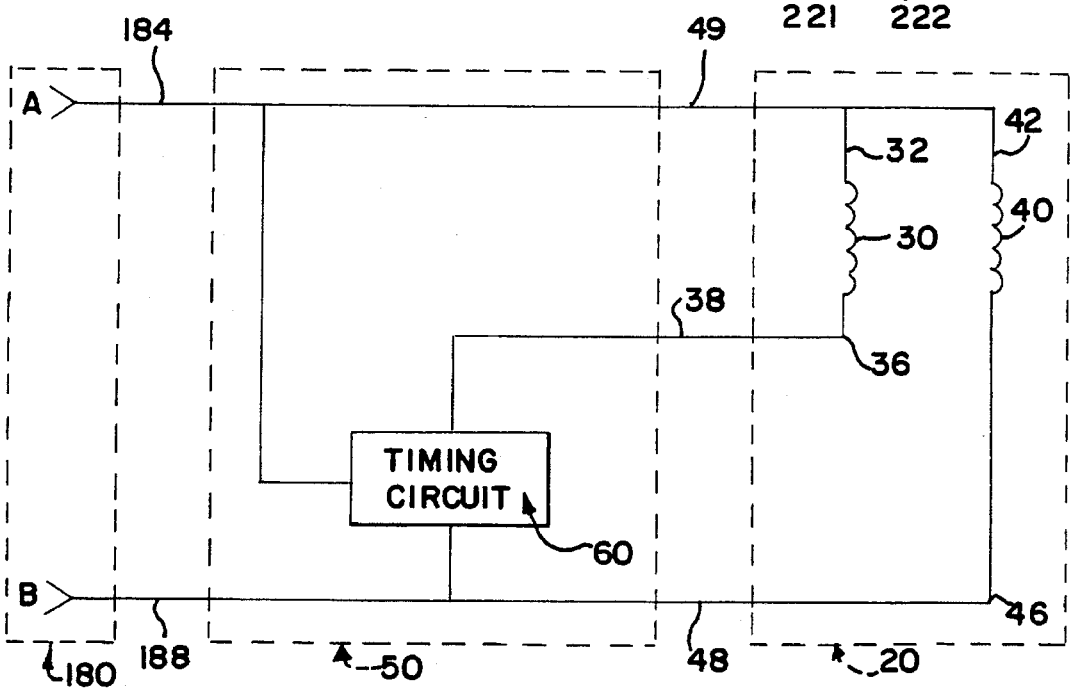
FIG. 14 is a schematic diagram of a third embodiment of the solenoid actuator of the present invention.

Referring back to FIGS. 10 and 3, instead of making an electrical connection via conductor 400 between the first side pull coil conductor 34 and the first side hold coil conductor 44 inside the timing circuit housing 50, alternatively, the electrical connection could be made inside the solenoid housing 20 by electrically connecting the first side 42 of the hold coil 40 and the first side 32 of the pull coil 30 as shown in FIG. 14. In this, the third embodiment of the invention, only three wires will be used to connect the timing circuit housing 50 to the coils 30,40 in the solenoid housing 20, namely a common power conductor 49, a second side pull coil conductor 38 and a second side hold coil conductor 48. The pull coil 30 and the hold coil 40 are still connected in a parallel configuration and the solenoid connector 180 is still connected to the timing circuit housing 50 by the first conductor 184 and the second conductor 188. Hence, the third embodiment of the invention is referred to as the 5-wire parallel version.

Figure 15:
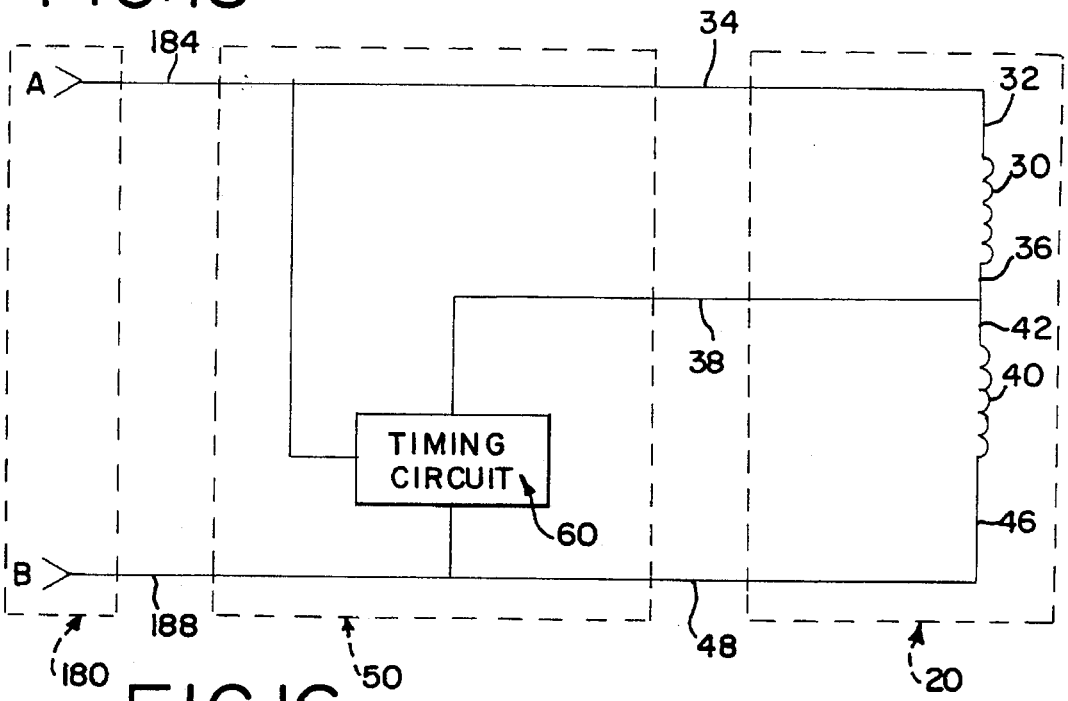
FIG. 15 is a schematic diagram of a fourth embodiment of the solenoid actuator of the present invention.

FIG. 15 shows the fourth embodiment of the invention, where the pull coil 30 and the hold coil 40 are connected in series. The solenoid connector 180 is connected to the timing circuit housing 50 by first and second conductors 184,186 and the timing circuit housing 50 is connected to the coils 30,40 in the solenoid housing 20 by three wires, namely, first side pull coil conductor 34, second side pull coil conductor 38 and second side hold coil conductor 48. Hence, the fourth embodiment of the present invention is referred to as the 5-wire series version.

In operation, the solenoid actuator 10 of FIG. 15 will initially have pull coil 30 connected to ground through the timing circuit 60 via second side pull coil conductor 38. Theoretically, no current will flow through hold coil 40, while a high current will be drawn by the pull coil 30. After a predetermined period of time, the timing circuit 60 will disconnect the pull coil 40 from ground. Thus, current will be drawn by the pull coil 30 and hold coil 40 combination connected in series. The pull coil 30 and hold coil 40 are designed so that they draw a low current when connected in series.

In both the 5-wire parallel and 5-wire series versions, three wires are mechanically and electrically connected to the coils 30,40 in the solenoid housing. This is advantageous over a four wire solenoid from a manufacturing standpoint for at least three reasons. First, one less wire connection needs to be made from the solenoid housing 20 to the timing circuit housing 50. Thus, costs are reduced by not having to supply the wire. Second, one less solder connection needs to be made to the circuit board 65 discussed below. Third, since in such applications standard solenoids have three wires exiting from the solenoid housing 20, physical adjustments during manufacture of the solenoid housing, both to its inside and outside, will be minimized.

Figure 16:
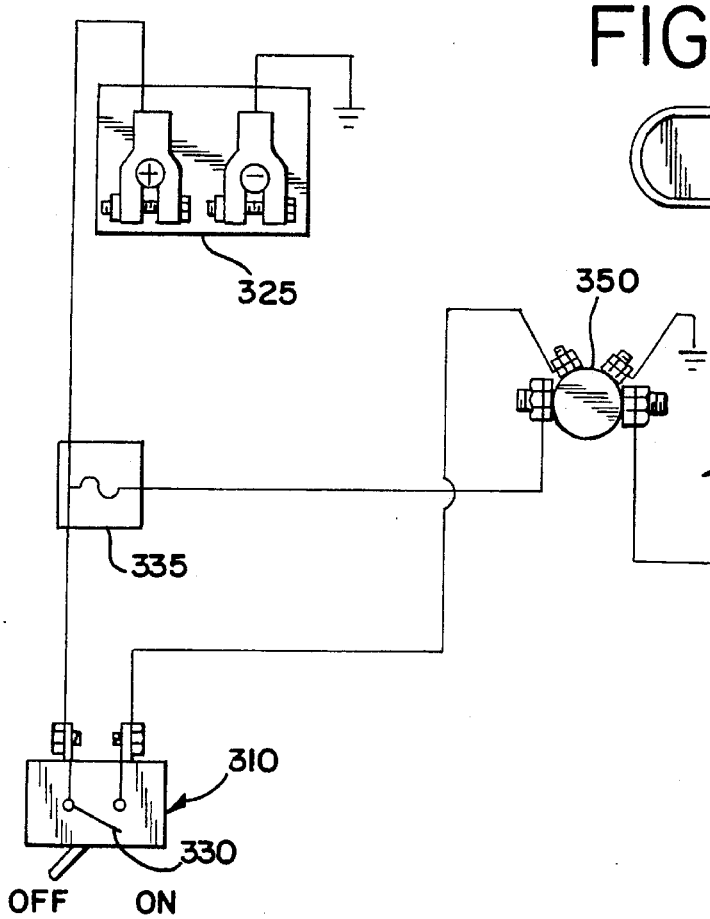
FIG. 16 is a schematic representation of a fourth wiring harness configuration with which the present invention can be used.
Figure 17:
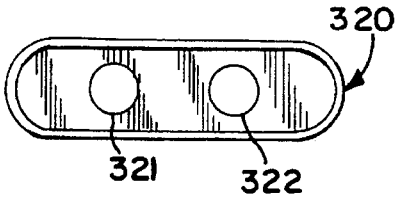
FIG. 17 is a schematic representation of the OEM wire harness plug of FIG. 16.

It is to be understood that the present invention can be used for a variety of two position solenoid applications and is not intended to be limited solely to applications involving fuel injection pumps. For example, FIG. 16 discloses a fourth OEM wiring harness 300 used in conjunction with a gasoline generator which positions a throttle in two preselected positions (usually low idle and run positions). The OEM wiring harness 300 provides a switch 310 to activate the power applied to an OEM wiring harness plug 320, having a first electrical contact 321 and a second electrical contact 322 (See FIG. 17), which mechanically mates with a solenoid connector 180 (see FIGS. 13, 14 or 15). The solenoid connector 180 has two pins, Pins A and B. The first and second electrical contacts, 321 and 322, are electrically connected to Pins A and B, respectively. As shown in FIG. 16, the switch 310 has two positions: on and off. In the off position, no power is available to the OEM wire harness plug 320. The second electrical contact 322 provides a ground wire or ground connector at Pin B.

When the switch 310 is flipped from the off position to the on position, power is applied from a battery 325 directly through a switch contact 330 which activates a throttle solenoid relay 350. Once the throttle solenoid relay 350 is activated, power is applied from the battery 325 through a fuse 335 and the throttle solenoid relay 350, thus, making a voltage available at the OEM wire harness plug 320 at the first electrical contact 321. The first electrical contact 321 and its related circuitry are capable of sustaining a high current for a short period of time and a low current over a long period of time. Since the OEM wire harness plug 320 has two electrical contacts 321,322, one may use the 6-wire parallel, 5-wire parallel or 5-wire series versions of the present invention.

Referring back to FIG. 1, a first wire bundle 90 provides a mechanical and electrical connection from the solenoid housing 20 to the timer housing 50. And, the second wire bundle 92 provides a mechanical and electrical connection from the timer housing 50 to the solenoid connector 80.

As shown in FIG. 8, the timing circuit housing 50 has a generally cylindrical, elongated, exterior shell 52. The shell is constructed of plastic of suitable grade for automotive electrical use. Contained within the exterior shell 52 is a circuit board 65 upon which the timing circuitry 60 is mounted. The first wire bundle 90 is mechanically connected to the timing circuit housing 50 at one of its ends and electrically connected to the circuit board 65 inside the timing circuit housing 50.

The second wire bundle 92 is mechanically connected to the timing circuit housing 50 at an opposite end of the shell 52 and electrically connected to the circuit board 65 inside the timing circuit housing 50.

Referring now to FIG. 9, the timing circuit housing 50 has a diameter D as shown. The first wire bundle 90 has a diameter defined by the diameter of the smallest circle which can be drawn to encompass the first wire bundle 90 as it enters the timing circuit housing 50. The second wire bundle 92 has a diameter defined by the diameter of the smallest circle that can encompass the second wire bundle 92 as it enters the timer circuit housing 50. The diameter D is approximately equal to or slightly larger than the diameter of the first wire bundle 90 and the diameter of the second wire bundle 92. Preferably, the diameter D is between a half and one inch.

Due to its shape, the timing circuit housing 50 does not have to be separately mounted in an engine compartment of a vehicle. Additionally, the timing circuit housing 50 occupies less space than previous timing circuit housings. Based upon the profile of the housing 50, it is intended that the housing be treated during mounting in a vehicle as merely part of the wire bundle. As such it may be secured directly or indirectly with normal wire harness clips or wraps. Thus, the diameter D is preferably sized with this goal in mind.

Preferably, the circuit board 65 and the first and second wire bundles 90 and 92 near their connection to the circuit board 65, are all potted in the timing circuit housing 50. The material used to pot the wires is an electrical grade potting compound of a conventional type. Heat shrink tubing (not shown) is used to provide strain relief.

Although the first and second wire bundles 90,92 have been described with reference to the 7-wire parallel version, it is to be understood that corresponding first and second wire bundles into and out of the timing circuit housing exist for the 6-wire parallel, 5-wire parallel and 5-wire series versions.

FIG. 20, shows the layout of transistors Q1 and Q2 of the timing circuitry 60 on the circuit board 65. Transistors Q1,Q2 are configured to lay on top of one another in order to increase space savings and to maintain a similar temperature in order to share the pull current approximately equally. Such a design permits the first, second or third conductors 84,86,88 (or first and second conductors 184, 188 in embodiments two, three and four) to lie on the top of transistor Q1. Furthermore, by placing one of the transistors atop the other, the length of the circuit board 65 and hence, the timing circuit housing 50 can be decreased.

Preferably, the circuit board 65 is dimensioned to have a length of 2.625 inches and a width of 0.625 inch, while the timing circuit housing 50 is approximately 3.5 inches long with an inner diameter of 0.705 inch.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A solenoid actuator comprising:

a solenoid housing containing a pull coil and a hold coil;

a first side pull coil conductor electrically connected to a first side of the pull coil;

a second side pull coil conductor electrically connected to a second side of the pull coil;

a first side hold coil conductor electrically connected to a first side of the hold coil;

a second side hold coil conductor electrically connected to a second side of the hold coil, the first and second side, pull and hold coil conductors all exiting from the solenoid housing;

a timing circuit housing containing a timing circuit, the timing circuit housing receiving the first and second side, pull and hold coil conductors, the second side pull coil conductor being connected to the timing circuit;

a ground conductor extending from the timing circuit housing and being electrically connected to the timing circuit and the second side hold coil conductor;

means in the timing circuit for switching the second side pull coil conductor from an electrical connection with the ground conductor to an open circuit;

a first power conductor extending from the timing circuit housing and being electrically connected to the first side hold coil conductor;

a second power conductor extending from the timing circuit housing and being electrically connected to the first side pull coil conductor; and, a solenoid connector which receives the first and second power conductors and the ground conductor.

2. The solenoid actuator of claim 1, wherein the timing circuit housing is located outside of and displaced a distance from the solenoid housing.

3. The solenoid actuator of claim 2, wherein the timing circuit housing is elongate in shape.

4. The solenoid actuator of claim 3, wherein the first and second side, pull and hold coil conductors, all form a first bundle of wires having a circumference, and the first and second power conductors, and the ground conductor, all form a second wire bundle having a circumference, and the timing circuit housing having a circumference sufficiently similar to the circumference of the first and second bundles to be mountable in a vehicle in substantially the same manner as the first and second bundles.

5. The solenoid actuator of claim 4, wherein the first wire bundle and second wire bundle entering and exiting the timing circuit housing are potted in the timing circuit housing.

6. The solenoid actuator of claim 1, wherein the means for switching includes one or more field-effect transistors to switch the second side pull coil conductor from ground to an open circuit configuration.

7. The solenoid actuator of claim 6, wherein the means further includes a resistor and capacitor combination to set a predetermined period of time for the switch to open.

8. The solenoid actuator of claim 7, wherein at least one of either the first power conductor, the second power conductor or the ground conductor lies above the stacked transistors inside the timing circuit housing.

9. The solenoid actuator of claim 7, wherein the predetermined period of time is in the range of one-half (½) to one and a half (1.5) seconds after the pull coil has been activated.

10. The solenoid actuator of claim 6, wherein two field-effect transistors are stacked atop one another inside the timing circuit housing.

11. A solenoid actuator for connection to an OEM wire harness plug having a first electrical contact providing a low current supply, a second electrical contact providing a high current supply and a third electrical contact providing a ground, the solenoid actuator comprising:

a pull coil and a hold coil, the pull coil having first side and second side pull coil conductors and the hold coil having first side and second side hold coil conductors;

a first direct electrical connection from the second electrical contact to the first side pull coil conductor, a second direct electrical connection from the first electrical contact to the first side hold coil conductor and a third electrical connection from the third electrical contact to the second side hold coil conductor;

control means for switching the second side pull coil conductor from the third electrical connection to an open circuit configuration after a predetermined period of time.

12. A solenoid actuator comprising:

a solenoid housing containing a pull coil and a hold coil;

a first side pull coil conductor electrically connected to a first side of the pull coil;

a second side pull coil conductor electrically connected to a second side of the pull coil;

a first side hold coil conductor electrically connected to a first side of the hold coil;

a second side hold coil conductor electrically connected to a second side of the hold coil, the first and second side, pull and hold coil conductors all exiting from the solenoid housing;

a timing circuit housing containing a timing circuit, the timing circuit housing receiving the first and second side, pull and hold coil conductors, the second side pull coil conductor being connected to the timing circuit;

a ground conductor extending from the timing circuit housing and being electrically connected to the timing circuit and the second side hold coil conductor;

means in the timing circuit for switching the second side pull coil conductor from an electrical connection with the ground conductor to an open circuit;

a first power conductor extending from the timing circuit housing and being electrically connected to both the first side hold coil conductor and the first side pull coil conductor inside the timing circuit housing; and, a solenoid connector which receives the first power conductor and the ground conductor.

13. The solenoid actuator of claim 12, wherein the timing circuit housing is located outside of and displaced a distance from the solenoid housing.

14. The solenoid actuator of claim 13, wherein the timing circuit housing is elongate in shape.

15. The solenoid actuator of claim 14, wherein the first and second side, pull and hold coil conductors, all form a first bundle of wires having a circumference, and the first power conductor and the ground conductor, form a second wire bundle having a circumference, and the timing circuit housing having a circumference sufficiently similar to the circumference of the first and second bundles to be mountable in a vehicle in substantially the same manner as the first and second bundles.

16. The solenoid actuator of claim 15, wherein the first wire bundle and second wire bundle entering and exiting the timing circuit housing are potted in the timing circuit housing.

17. The solenoid actuator of claim 12, wherein the means for switching includes one or more field-effect transistors to switch the second side pull coil conductor from ground to an open circuit configuration.

18. The solenoid actuator of claim 17, wherein the means further includes a resistor and capacitor combination to set a predetermined period of time for the switch to open.

19. The solenoid actuator of claim 18, wherein the predetermined period of time is in the range of one-half (½) to one and a half (1.5) seconds after the pull coil has been activated.

20. A solenoid actuator comprising:

a solenoid housing containing a pull coil and a hold coil;

a first side pull coil conductor electrically connected to a first side of the pull coil;

a second side pull coil conductor electrically connected to a second side of the pull coil;

a first side hold coil conductor electrically connected to a first side of the hold coil;

a second side hold coil conductor electrically connected to a second side 0f the hold coil, the first side pull coil conductor and first side hold coil conductor electrically connected to each other inside the solenoid housing and fed by a common power conductor, the common power conductor, second side pull coil conductor and second side hold coil conductors all exiting from the solenoid housing;

a timing circuit housing containing a timing circuit, the timing circuit housing receiving the common power conductor, the second side pull coil conductor and the second hold coil conductor, the second side pull coil conductor being connected to the timing circuit;

a ground conductor extending from the timing circuit housing and being electrically connected to the timing circuit and the second side hold coil conductor;

means in the timing circuit for switching the second side pull coil conductor from an electrical connection with the ground conductor to an open circuit;

a first power conductor extending from the timing circuit housing and being electrically connected to the common power conductor; and, a solenoid connector which receives the first power conductor and the ground conductor.

21. The solenoid actuator of claim 20, wherein the timing circuit housing is located outside of and displaced a distance from the solenoid housing.

22. The solenoid actuator of claim 21, wherein the timing circuit housing is elongate in shape.

23. The solenoid actuator of claim 22, wherein the common power conductor, second side pull coil conductor and the second side hold coil conductor, all form a first bundle of wires having a circumference, and the first power conductor and the ground conductor, form a second wire bundle having a circumference, and the timing circuit housing having a circumference sufficiently similar to the circumference of the first and second bundles to be mountable in a vehicle in substantially the same manner as the first and second bundles.

24. The solenoid actuator of claim 23, wherein the first wire bundle and second wire bundle entering and exiting the timing circuit housing are potted in the timing circuit housing.

25. The solenoid actuator of claim 20, wherein the means for switching includes one or more field-effect transistors to switch the second side pull coil conductor from ground to an open circuit configuration.

26. The solenoid actuator of claim 25, wherein the means further includes a resistor and capacitor combination to set a predetermined period of time for the switch to open.

27. The solenoid actuator of claim 26, wherein the predetermined period of time is in the range of one-half (½) to one and a half (1.5) seconds after the pull coil has been activated.

28. A solenoid actuator comprising:

a solenoid housing containing a pull coil and a hold coil;

a first side pull coil conductor electrically connected to a first side of the pull coil;

a second side pull coil conductor electrically connected to a second side of the pull coil and a first side of the hold coil;

a second side hold coil conductor electrically connected to a second side of the hold coil, the first side pull coil conductor and the second side pull coil conductor and the second side hold coil conductor all exiting from the solenoid housing;

a timing circuit housing containing a timing circuit, the timing circuit housing receiving the first side pull coil conductor and the second side pull coil conductor and the second side hold coil conductor, the second side pull coil conductor being connected to the timing circuit;

a ground conductor extending from the timing circuit housing and being electrically connected to the timing circuit and the second side hold coil conductor;

means in the timing circuit for switching the second side pull coil conductor from an electrical connection with the ground conductor to an open circuit;

a first power conductor extending from the timing circuit housing and being electrically connected to the first side pull coil conductor; and, a solenoid connector which receives the first power conductor and the ground conductor.

29. The solenoid actuator of claim 28, wherein the timing circuit housing is located outside of and displaced a distance from the solenoid housing.

30. The solenoid actuator of claim 29, wherein the timing circuit housing is elongate in shape.

31. The solenoid actuator of claim 30, wherein the first side pull coil conductor, second side pull coil conductor and second side hold coil conductor, all form a first bundle of wires having a circumference, and the first power conductor and the ground conductor, form a second wire bundle having a circumference, the timing circuit housing having a circumference sufficiently similar to the circumference of the first and second bundles to be mountable in a vehicle in substantially the same manner as the first and second bundles.

32. The solenoid actuator of claim 31, wherein the first wire bundle and second wire bundle entering and exiting the timing circuit housing are potted in the timing circuit housing.

33. The solenoid actuator of claim 28, wherein the means for switching includes one or more field-effect transistors to switch the second side pull coil conductor from ground to an open circuit configuration.

34. The solenoid actuator of claim 33, wherein the means further includes a resistor and capacitor combination to set a predetermined period of time for the switch to open.

35. The solenoid actuator of claim 34, wherein the predetermined period of time is in the range of one-half (½) to one and a half (1.5) seconds after the pull coil has been activated.

* * * * *

UNITED STATES PATENT AND TRADEMARK OFFICE

CERTIFICATE OF CORRECTION

PATENT NO. : 5,592,356

DATED : Jan. 7, 1997

INVENTOR(S) : Ryl et al.

It is certified that error appears in the above-identified patent and that said Letters Patent is hereby corrected as shown below:

In Col. 5, line 21, delete "Figs., 8 and 9" and replace with --Figs. 18 and 19--.

In Col. 8, line 54, delete "Fig. 1" and replace with --Fig. 11--.

In Col. 8, line 62, delete "Fig. 3" and replace with --Fig. 13--.

In Col. 9, line 5, delete "3" and replace with --13--.

In Col. 10, line 42, delete "Fig. 9" and replace with --Fig. 19--.

In Claim 20, Col. 13, line 49, delete "Of" and replace with --of--.

Signed and Sealed this

Twenty-ninth Day of April, 1997

*Attest:*

Bruce Lehman

BRUCE LEHMAN

*Attesting Officer*

*Commissioner of Patents and Trademarks*